US005727346A

United States Patent [19]

Lazzarini et al.

[11] Patent Number: 5,727,346

[45] Date of Patent: Mar. 17, 1998

[54] APPARATUS FOR QUICK-RELEASABLE ATTACHMENT OF A TARGET ILLUMINATING DEVICE TO A FIREARM

[76] Inventors: Donald Lawrence Lazzarini, 3566 Berry Way, Santa Clara, Calif. 95051; Harry Dwyer, III, 1573 Ardenwood Dr., San Jose, Calif. 95120

[21] Appl. No.: 784,156

[22] Filed: Jan. 15, 1997

[51] Int. Cl.[6] ..... F41G 1/34

[52] U.S. Cl. ..... 42/103

[58] Field of Search ..... 42/103; 362/110–114

[56] References Cited

U.S. PATENT DOCUMENTS

| | | | |
|---|---|---|---|
| 689,547 | 12/1901 | James | 42/103 |
| 894,306 | 7/1908 | Wright | 42/103 |
| 1,128,739 | 2/1915 | Weigel | 362/110 |
| 1,149,705 | 8/1915 | Ward | 362/110 |
| 1,262,270 | 4/1918 | Schmidt et al. | 362/110 |
| 1,263,667 | 4/1918 | Henderson et al. | 362/114 |
| 1,338,239 | 4/1920 | Matys | 362/114 |
| 1,452,651 | 4/1923 | Norrlin | 375/1 |
| 1,826,004 | 10/1931 | Key | 42/103 |
| 1,993,979 | 3/1935 | Reed | 42/103 |
| 2,017,585 | 10/1935 | Casey | 42/103 |
| 2,314,061 | 3/1943 | Whaley | 42/103 |
| 2,597,565 | 5/1952 | Chandler et al. | 42/103 |
| 2,844,710 | 7/1958 | Zinsser | 42/103 |
| 2,912,566 | 11/1959 | Cornett | 42/103 |
| 3,488,488 | 1/1970 | Crouch | 42/103 |
| 3,513,581 | 5/1970 | Slater | 42/103 |
| 4,348,716 | 9/1982 | Storm et al. | 362/110 |
| 4,542,447 | 9/1985 | Quakenbush | 362/114 |
| 4,697,226 | 9/1987 | Verdin | 362/110 |
| 4,707,772 | 11/1987 | Jimenez et al. | 362/110 |
| 4,856,218 | 8/1989 | Reynolds, Jr. | 42/103 |
| 4,894,941 | 1/1990 | Karow, Jr. | 42/103 |
| 5,042,186 | 8/1991 | Bechtel | 42/103 |
| 5,560,703 | 10/1996 | Capps, III | 362/114 |

*Primary Examiner*—Charles T. Jordan
*Assistant Examiner*—Meena Chelliah

[57] ABSTRACT

A mounting apparatus for the quick-detachable securing of a flashlight or a like target illumination device to a firearm. The mounting device includes a passage for receiving the barrel of the flashlight or the like. The passage is provided with a resilient means to press the flashlight longitudinally along approximately the same axis as the firearm's barrel in opposition to a springably-positioned latch system engaging one end of the flashlight which prevents its dislodgment upon movement of the firearm during handling or discharge, yet enabling relatively quick, one-handed release and replacement of the entire flashlight. The flashlight or the like is prevented from rotating in the passage by a groove in the interior of the passage that engages part of the flashlight body thereby indexing it so that the flashlight's controls are always in the same position and accessible to the user.

12 Claims, 4 Drawing Sheets

APPARATUS FOR QUICK-RELEASABLE ATTACHMENT OF A TARGET ILLUMINATING DEVICE TO A FIREARM

BACKGROUND

1. Field of the Invention

The subject invention relates to firearms and more specifically to methods and apparatus for the quick-releasable attachment of a target illuminating devices such as a flashlight or the like to a firearm.

2. Prior Art

Illuminating devices are often employed by police and civilian security agencies in situations where there is insufficient ambient light to obtain a clear view of the possible target. Prior to discharging any firearm in such a situation, the individual in control of that firearm has a legal and ethical duty to confirm the identify the possible target and determine that the use of lethal force would be justifiable.

Unless the individual controlling the firearm utilizes an electronic light amplification device, this situation requires that the target be artificially illuminated in some way. Since electronic light amplification "night vision" devices are quite expensive, relatively bulky, and difficult to maintain, most police and security officers utilize some sort of flashlight to illuminate the target.

Effectively using a hand-held flashlight in conjunction with a firearm presents a problem. Except for certain unusual situations, modern firearms doctrine dictates that all firearms, even handguns, be controlled with both hands. This precludes holding a flashlight in one hand while attempting to control and operate the firearm solely with the other. Even where such a method might be feasible with some handguns, effectively controlling and operating a shotgun, carbine or submachine gun with one hand is not practical. While nearly all police and security agencies train officers in methods for holding and operating a flashlight while simultaneously controlling a firearm, it is widely recognized in the security and law enforcement field that such approaches are difficult to master and often ineffective in the field.

Because of this, various ways to mount target illuminating devices such as flashlights, lasers, and the like to firearms have been developed. Many of these approaches are primarily designed to provide the firearm shooter with assistance in aiming the firearm. Only a relative few address the practical and legal issues of providing general target illumination so that the shooter may determine if the use of lethal force is justified and if so, to then engage the target effectively. Those few approaches for illuminating a potential target which have been disclosed previously have numerous practical and cost limitations that have precluded their widespread adoption.

Proposals involving the fastening of lights to firearms go back for almost 80 years. U.S. Pat. Nos. 689,547, 894,306, 1,149,705, 1,452,651, 1,826,004, 1,993,979, 2,017,585, 2,844,710 and 2,912,566 propose ways to clamp a flashlight or incandescent lamp with lens, reflector arrangement and on-off switch to a handgun. In addition U.S. Pat. No. 1,128,739 discloses a bracket for holding a light that engages a particular feature of a revolver barrel. U.S. Pat. No. 1,262,692 discloses a lamp attachment for firearms, and U.S. Pat. No. 1,262,270 discloses a pocket lamp attachment for firearms.

U.S. Pat. No. 1,263,667 discloses a flashlight attachment for firearms using straps or bands, and U.S. Pat. No. 1,338,239 discloses a search light for firearms, and U.S. Pat. No. 2,017,585 discloses a light attachment for firearms. U.S. Pat. No. 2,314,061 discloses a structure for mounting a flashlight to a revolver. U.S. Pat. No. 2,597,565 discloses a structure for building a flashlight into the forearm of a submachine gun. U.S. Pat. No. 3,488,488 discloses a structure for building a flashlight into the carrying handle of a shotgun. U.S. Pat. No. 3,523,581 discloses a flashlight attachment for shotguns intended to be mounted in the cartridge magazine. U.S. Pat. No. 4,707,772 discloses a method for mounting a flashlight to a telescopic sighting systems. U.S. Pat. No. 4,856,218 discloses a method for building a flashlight into a shotgun forearm. U.S. Pat. No. 4,894,941 discloses a method for releasably clamping a flashlight to a cylindrical firearm barrel. U.S. Pat. No. 5,042,186 discloses a structure for mounting a special lighted sighting aid to the ejector rod of a revolver. U.S. Pat. No. 4,697,226 discloses an apparatus in which a Velcro strap is used to retain a certain model of flashlight in a tube mounted on a firearm, and U.S. Pat No. 5,560,703 discloses a method for attaching a bracket to a handgun grip that in turn engages a second bracket fastened to a flashlight.

Despite the clear need for the very functionality which the prior art attempts to address, none of the above-referenced prior art is currently in widespread use. Only the single structure disclosed in U.S. Pat. No. 4,856,218 is readily available on a commercial basis and, because of its high cost and many other disadvantages, is primarily used only by certain highly-specialized, Special Weapons And Tactics ("SWAT") police units.

The realities of ordinary police and security work are such that the need for illuminating a potential target prior to engaging it might occur only a few times in the career of any particular officer. However, when a need to illuminate a potential target does arise, it becomes a highly critical one. Failure to monitor a possible hostile target's actions puts the officer and his or her colleagues at risk of being shot or assaulted. Failure to properly identify a target or correctly determine that lethal force is indeed justified can result in destroying an innocent life along with the officer's career and his or her department's reputation. Clearly, illuminating the area in front of the officer's firearm without also occupying one of the officer's hands to hold a separate flashlight is an essential need. But just as importantly, the flashlight being so used needs to have fully-charged batteries and work reliably.

Keeping a flashlight or the like mounted on a firearm during the many months and possibly years between its essential tactical uses has numerous disadvantages. It puts extra weight on the firearm thus making it harder to carry or deploy at other times. More importantly, when compared to firearms, flashlights and the like contain perishable batteries and relatively fragile electrical mechanisms. Because of this, they are easily damaged and require frequent testing and battery replacement to ensure reliable operation at the moment of need.

Even when semi-permanent systems .such as those disclosed in U.S. Pat. No. 4,856,218 permit the removal of part of the light system until needed, the relatively delicate switching mechanisms and threaded battery case receptacles remain attached to or part of the firearm. These parts add cost and may be easily damaged or contaminated by debris as they are being handled and transported or when they are stored for long periods of time in patrol vehicles or other locations.

Being able to rapidly attach an officer's duty flashlight—as issued to the officer and carried on his or her person at all times—to a firearm would address these issues. Such flashlights are in frequent use and therefore their condition is known. Further, should an officer's duty light fail, there are usually other identical lights readily available from patrol vehicles or other officers. This reliability factor and the need for very rapid replacement of the entire light system in the event of failure is an Unrecognized Problem in all the prior art. All the structures and methods disclosed to date require that a series of relatively complex and time-consuming manual manipulations be undertaken in order to attach or detach a flashlight from a firearm.

In many cases, the flashlight is either part of, or semi-permanently attached to, some component of the firearm by being directly threaded to it or through the use of threaded fasteners. In almost all other approaches, the prior art relies on various bands, straps, clamps or other devices that rely on producing forces normal to the longitudinal portion of the battery case barrel or other portion of the flashlight to induce a gripping action on the flashlight thereby precluding its rapid insertion or removal. For example, the structure disclosed by U.S. Pat. No. 4,697,226 requires that the flashlight be significantly modified with a re-wired switching mechanism, then retained with a cumbersome Velcro strap assembly. As with most of the prior art, in order to operate as part of the invention, the illuminating device specified needs to be modified to such a degree as to be impractical for other usage separate from it.

The rest of the prior art specifies that relatively bulky mounting devices be attached to the flashlight rendering it unfit for normal carry or otherwise specify systems that enable the flashlight to only be attached to cylindrical objects. While this is a possible solution with some older revolver-type handguns, few modern firearms such as semi-automatic pistols or police submachine guns present such a cylindrical surface to attach to.

In an emergency response situation, police or security officers do not have the time or free hands to execute a complex process of mounting a flashlight on a firearm or becoming involved with disassembling a semi-permanently mounted device to replace a discharged battery or a defective lamp. The officers also do not have the time in the middle of an emergency response to clean out debris from a battery compartment or to somehow find another working light system with the proper specialized modification that will enable it to mount on their firearm.

What officers need is a way to quickly mount any one of their department's standard issue flashlights to their firearm and be able to operate that flashlight as part of their usual handling of that firearm. They also need to be able to quickly replace that flashlight with another readily available one should it fail and to accomplish all of these objectives in moments with one hand and while under extreme stress. These needs have been long-felt by many in the law enforcement and security community and have been unsolved by any of the prior art.

OBJECTS AND ADVANTAGES

It is the general object of the subject invention to overcome the disadvantages and satisfy the needs expressed or implied in the above Background Statement or in other parts hereof. It is a gemain object of the subject invention to provide improved target illuminating systems for firearms.

Several other objects and advantages of the subject invention are to provide improved and more:

(a) reliable target illuminating systems for firearms by enabling very quick one-handed attachment or replacement of an entire self-contained target illuminating device such as a flashlight or the like to any firearm equipped with the subject invention;

(b) widely available target illuminating systems for firearms by enabling governmental or private security agencies to standardize on a single hand-held illumination device, such as a particular brand or model of a rechargeable or disposable flashlight or the like, which may then be carried and used independently by all officers as well as stored in vehicles or other locations and yet also be rapidly attached with one hand to any firearm equipped with the subject invention or rapidly removed and/or replaced completely with another readily-available flashlight or the like if the original is found inoperative, defective, or is needed for other purposes;

(c) reliable target illuminating systems for firearms by preventing the accumulation of debris as frequently occurs with some of the prior art for firearm mounted flashlight holders or flashlight battery housings mounted on firearms stored vertically in police vehicles or other locations; and (d) inexpensive target illuminating systems for firearms by enabling access to all operating controls that are integral to the self-contained flashlight or like device rather than replicating them as part of the apparatus attached to the firearm.

DRAWING FIGURES

FIG. 2 shows the above-mentioned cut-away view with the example flashlight removed.

FIG. 3 shows a enlarged version of the cut-away view with the example flashlight inserted and engaged by the latching system of the apparatus.

FIG. 4 shows a further enlarged view to better illustrate the latching system.

REFERENCE NUMERALS IN DRAWINGS

10. Remington Brand, Model 870 Police, Shotgun
11. Shotgun Fore-end
12. Shotgun Barrel
20. StreamLight Brand, Model Poly Stinger, Flashlight
21. Flashlight Head
22. Flashlight Barrel
23. Flashlight Recharging Lug
24. Flashlight Lens Retention Bezel
25. Flashlight Lens
26. Flashlight Switch
30. Target Illuminating Mounting Apparatus (Subject Invention)
31. Interior Passage
32. Indentation or Groove
**33*a*** Mounting Surface
**33*b*** Mounting Adhesive
**33*c*** Mounting Screws
34. Exterior Finger Groves
35. O-Ring
36. O-Ring Retaining Groove
37. Switch Access Port
38. Passage Opening
39. Body Material 40. Latching Mechanism
41. Latching Spring
42. Polymer Cam
43. Displaced Latch DESCRIPTION—FIGS. 1 through 4

Figure 1:
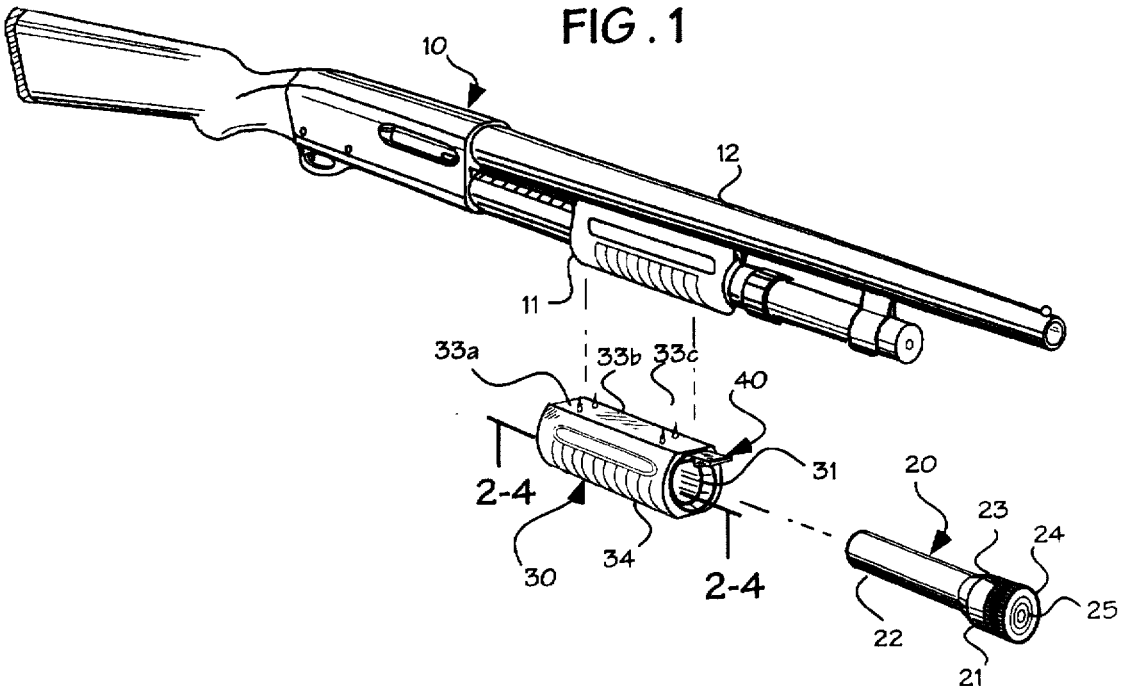
FIG. 1 shows a typical embodiment of the invention as it would be attached to an example of a common police-style shotgun.

As shown in FIG. 1, a target illuminating mounting Apparatus 30 is provided for releasibly securing a flashlight 20 or the like to a fore-end 11 or other part of a firearm. Said Apparatus has an upper surface 33*a* which is shaped specifically to mate closely with a particular part of the particular firearm for which it is intended and can be secured with adhesive 33*b* or as in this example, screws 33*c*.

By way of example, in this embodiment a firearm 10 is shown as a common Remington brand, Model 870 Police, shotgun. Said Apparatus is shown as having an external configuration 34 that has been modified to mimic the contour of such a firearm's typical factory-supplied fore-end 11 to which it may be mounted or integrated as a single unit.

Figure 2:
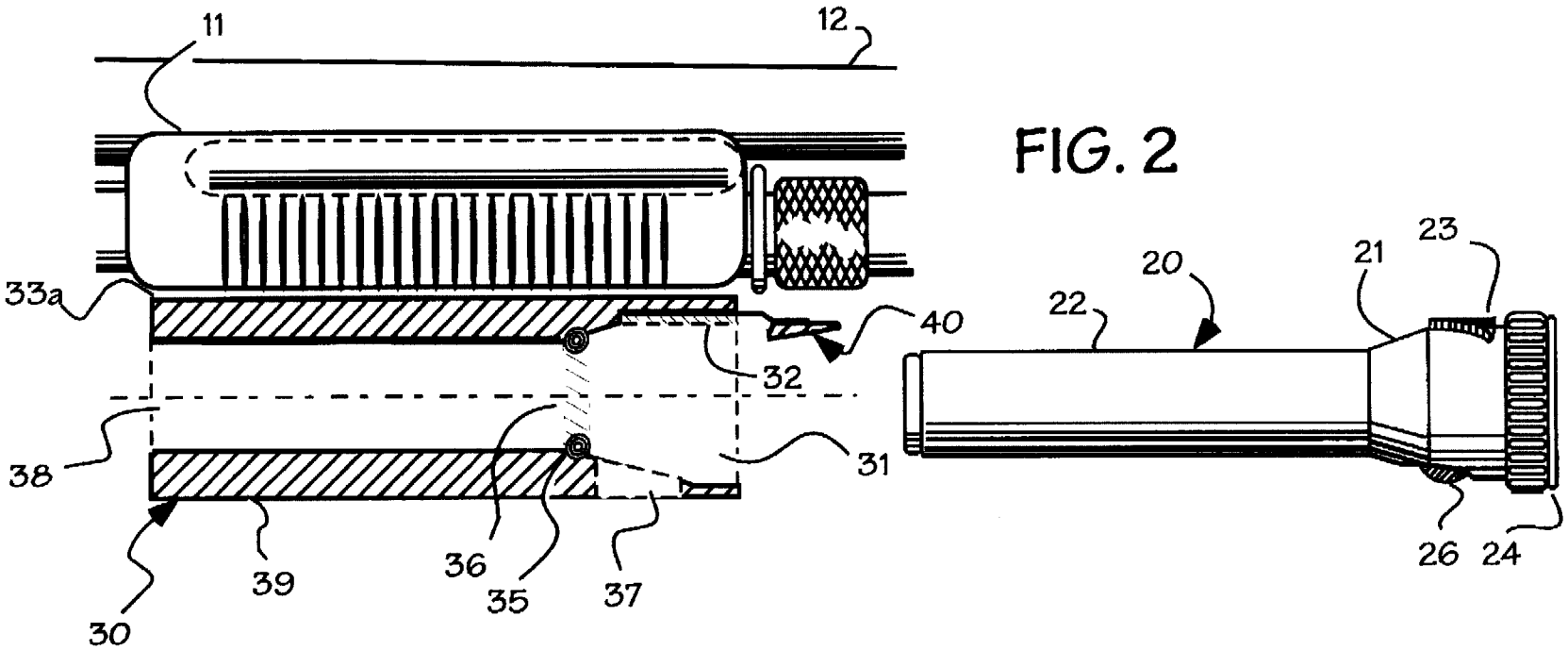
FIG. 2 through FIG. 4 show close-up side views of the invention which has been cut away along the axis as shown in FIG. 1 to better show the internal construction.

As is well known, a flashlight such as is shown by way of example in FIG. 2 typically includes a barrel portion 22 which typically houses disposable or rechargeable batteries, and a head portion 21 which typically houses a lamp, reflector and lens assembly 25 which in turn are often retained in place by a bezel 24. By way of example, FIG. 2 illustrates such a flashlight as being a StreamLight brand, model Poly Stinger, flashlight which is a common rechargeable flashlight often issued to police and security officers for patrol use. In this embodiment, the example flashlight's head also contains a switching mechanism 26, and a recharging lug 23 intended by the manufacturer to engage with said flashlight's recharging base unit when said flashlight is not in use.

Figure 3:
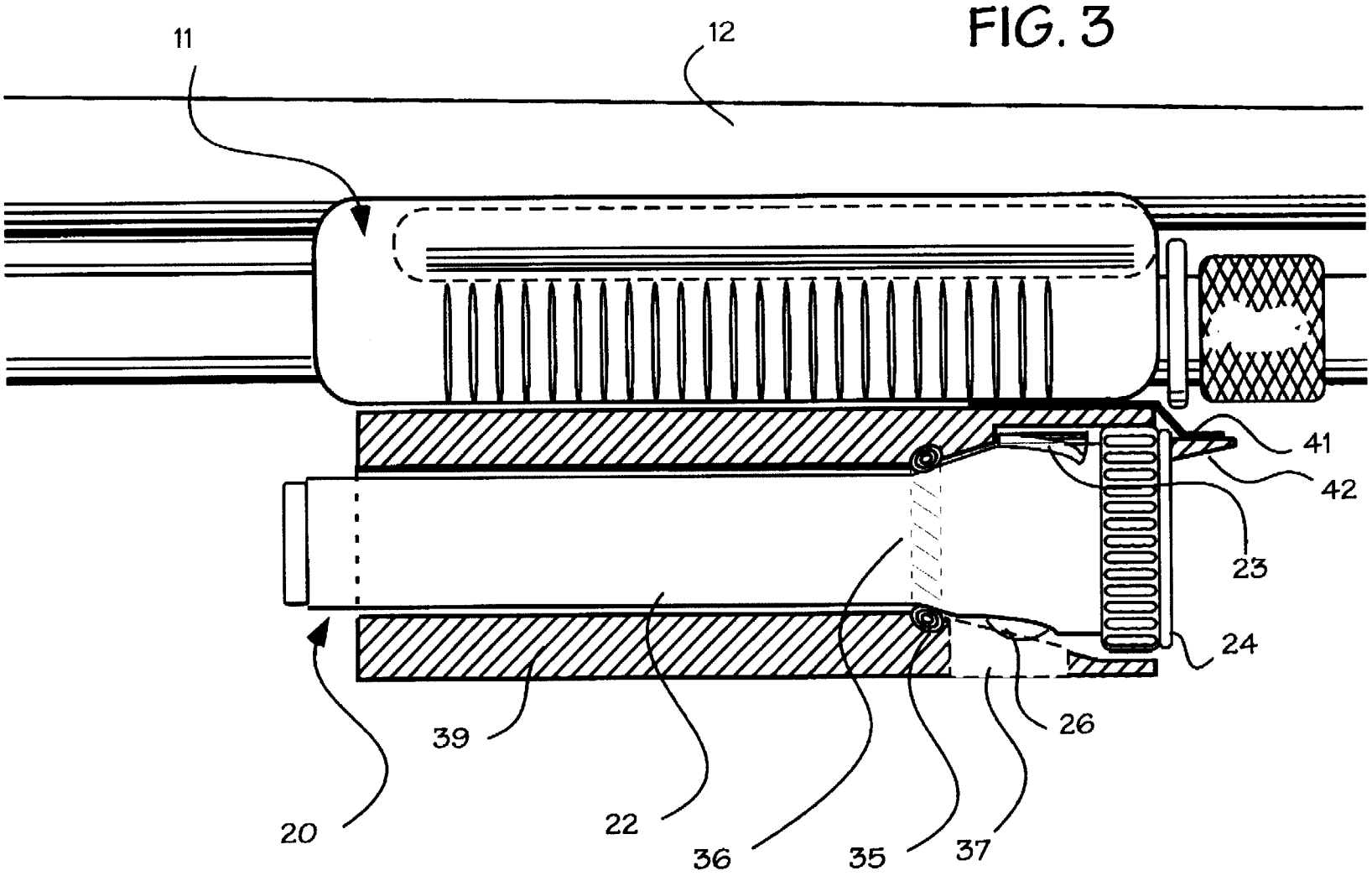
Figure 4:
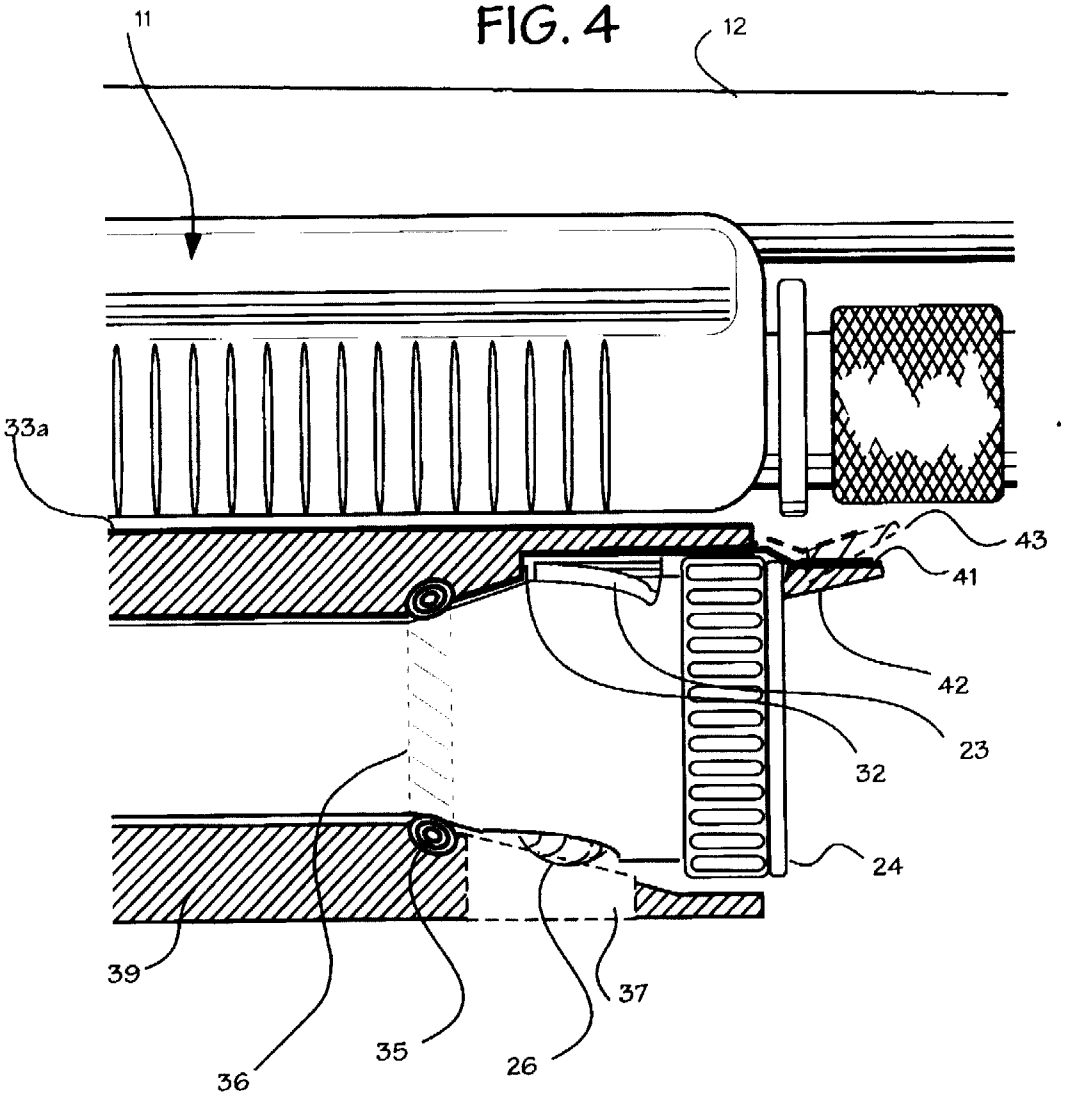

An example of a preferred embodiment of said Apparatus being disclosed herein 30, is shown in FIG. 2 through FIG. 4 cut away along a plane as designated in FIG. 1. The body material 39 of said Apparatus may be injection molded or cast out of any of a number of types of polymers or composite materials or machined out of any one of a number of polymers, composites, nonferrous metals or wood. In this embodiment, body material 39 is assumed to be fiber-reinforced polyester.

As well known to those experienced in the shotgun art, a fore-end 11 in such a firearm is grasped by the user and manipulated with a back-and-forth sliding action to actuate a mechanism 13 in the example firearm for the purpose of ejecting spent shotgun shells, chambering live shells and cocking the hammer. In this embodiment, the user would grasp finger grooves 34 molded into the exterior of said Apparatus and manipulate it in a fashion identical to the way he or she would grasp a shotgun's factory installed fore-end 11.

As seen in FIG. 2, said Apparatus contains a passage 31 in approximately the same plane as, and parallel to, the barrel of the example firearm 12 which is fabricated to accept a specific barrel 22 of a specific example StreamLight flashlight 20. Such passage 31 is further modified with an indentation in the form of a groove, notch or key-way 32 that engages some portion of said example flashlight. By way of example, in this embodiment, said indentation accepts a recharging lug 23 on the example flashlight. As the flashlight is inserted into opening 38 of passage 31, said recharging lug 23 is engaged by said indention 32.

As seen in FIG. 3, this engagement insures that the flashlight can be inserted in only one orientation, prevents it from rotating once inserted, and also indexes a switch 23 directly behind an access port 37, thus enabling the operator of the firearm to control the flashlight. By utilizing the flashlight's integral switch mechanisms, the operator has full ambidextrous access to all the features associated with that particular flashlight system such as "momentary on" or "toggle on/off" functions, while the expense and relative fragility of those electrical components are not part of said Apparatus.

As seen particularly in FIG. 4, a head 21 of the example flashlight 20 bears on a resilient material which, in this embodiment, is a neoprene O-ring 35 mounted in a circumferential groove 32 provided in an inner wall of the passage 31 and shown in FIG. 2 through FIG. 4 with dashed lines. The resiliency of the O-ring tends to resist and cushion the relative rearward motion of the flashlight as the example firearm is pointed in an upwards direction or the fore-arm to which the example flashlight is mounted is manipulated by the operator as he or she cycles the action of the example firearm between discharges.

The resiliency of an O-ring 35 also tends to push the example flashlight longitudinally forward along an axis approximately parallel to the barrel of the example firearm. This causes the flashlight to maintain engagement with a retaining catch 40. Such a retaining catch is formed out of a springable material, either polymer or metal.

In this embodiment, said retaining latch is assumed to be fabricated out of a flat stainless steel spring 41 riveted to a polymer cam 42 and fastened to an inside surface of the flashlight passage 31. In this embodiment, said polymer cam 42 on said latch 40 engages a front lens retaining bezel 24 of the example flashlight 20 thereby preventing the flashlight from becoming dislodged upon rearward recoil of the firearm when it is discharged, or upon its being pointed down from a horizontal position.

Of particular note is the fact that said passage 31 contains an unobstructed opening at both ends 38. This prevents an accumulation of debris in the passage as tends to occur in closed-end tubes stored vertically in environments such as police patrol vehicles.

OPERATION—FIGS. 1 through 4

To utilize this embodiment of said Apparatus, the user operating the example firearm 10 would take a fully charged and operational version of the example flashlight 20 from its recharging bracket in a police patrol car or off his or her personal equipment belt and insert it into the passage 31 of the subject target illuminating mounting device 30. A recharging lug 23 on the example flashlight engages an indentation in the interior wall of the passage 31 properly aligning the example flashlight and preventing it from rotating.

The example flashlight would then be pushed into said passage 31. As best seen in FIG. 4, the head 21 of the flashlight and its retaining bezel 24, would cause a polymer cam 42 to be forced laterally away from the axis of said Apparatus. The user would continue to insert the flashlight until it seats against an O-ring 36 and a polymer cam 42 on a retention latch 40 passes and, due to the springable action of its support 41, snaps down on to and thus engages with a front edge of the example flashlight's lens bezel 24. To operate the example flashlight, the user would insert a finger through an access port 37 to actuate the example flashlight's built-in switch 23.

To remove or replace the example flashlight 20, the user would grasp the example flashlight's head 21 between his or her thumb and second finger while simultaneously depressing said polymer cam 42 portion of said retention latch 40 with the forefinger, thus displacing said cam on said retaining latch to a position as shown in 43 and disengaging it from said lens bezel 24 thus permitting the example flashlight 20 to be withdrawn from said passage 31.

SUMMARY, RAMIFICATIONS AND SCOPE

Accordingly it is readily apparent that the subject invention solves several problems previously unrecognized or addressed by the prior art. Law enforcement and security officers need reliable methods to illuminate potential targets so that they can correctly identify them, monitor their actions and by those actions determine if the use of lethal force is justifiable.

Compared to police arms, flashlights are relatively fragile and perishable devices. Permanently mounting batteries, switches, and electrical lamps to firearms involves numerous disadvantages including expense, weight and bulk but most importantly reliability. Permanently mounted flashlights that fail can not be repaired or replaced quickly enough to be useful in emergency law enforcement applications. p The Apparatus that is the subject of this invention address these above-stated needs in numerous ways:

Since it does not contain switches, battery compartments, or other electrical components, the subject invention may be manufactured relatively inexpensively and made more widely available to security and police officers then current products.

The flashlight or the like need not be mounted on the firearm until the moment of use, meaning that the bulk and weight of the light device does not interfere with the firearm's normal use.

In the event of failure, the mounted flashlight or the like can be immediately replaced with other readily available units that would typically already be on the person of the officer using the firearm or his or her partner, or in their patrol vehicle.

We claim:

1. An apparatus for quick detachably securing a target illuminating device to a firearm, said device selected from the group consisting of flashlights and light emitting diodes and lasers, the improvement comprising in combination:

a longitudinally extending passage transversely large enough to accept said device and containing a releasable retention system for said device comprising of a resilient means to press said target illuminating device along approximately the same axis as a firearm's barrel and in opposition to a springably positioned latching system engaging a terminus of said device as a means to prevent dislodgment of said device upon movement of said firearm during handling or discharge.

2. The apparatus in claim 1, further comprising a means to release said latching system and remove said device with one hand.

3. The apparatus in claim 1, further comprising an indentation associated with the interior of said passage longitudinally engaging a projecting component of said device as a means to prevent rotation of said device.

4. The apparatus in claim 1, further comprising a projection associated with the interior of said passage longitudinally engaging a certain aspect of said device, such aspect selected from a group containing a groove and a notch as a means to prevent rotation of said device.

5. The apparatus in claim 1, further comprising a means for the prevention of the accumulation of debris in said passage when said firearm is stored in an approximately vertical position.

6. The apparatus in claim 1, further comprising a means to securely fasten said apparatus to a specific component of said firearm, said component selected from the group consisting of a firearm barrel and a firearm forearm and a firearm stock and a firearm hand grip and a firearm frame.

7. In a method for quick detachably securing a target illuminating device to a firearm, said device selected from the group consisting of flashlights and light emitting diodes and lasers, the improvement comprising in combination the steps of:

providing a longitudinally extending passage transversely large enough to accept said device, and providing a releasable retention system for said device comprising of resilient means to press said target illuminating device along approximately the same axis as a firearm's barrel and in opposition to a springably positioned latch engaging a terminus of said device providing a means to prevent dislodgment of said device upon movement of said firearm during handling or discharge.

8. A method as claimed in claim 7, further including the steps of providing a means to release said latch and remove said device with one hand.

9. A method as claimed in claim 7, further including the steps of providing an indentation associated with the interior of said passage such as to longitudinally engage a projecting component of said device as a means to prevent rotation of said device.

10. A method as claimed in claim 7, further including the steps of providing a projection associated with the interior of said passage such as to longitudinally engage a certain aspect of said device such aspect selected from a group containing a groove and a notch as a means to prevent rotation of said device.

11. A method as claimed in claim 7, further including the steps of providing a means for the prevention of the accumulation of debris in said passage when said firearm is stored in an approximately vertical position.

12. A method as claimed in claim 7, further including the steps of providing a means to securely fasten said apparatus to a specific component of said firearm, said component selected from the group consisting of a firearm barrel and a firearm fore-end and a firearm stock and a firearm hand grip and a firearm frame.

* * * * *